United States Patent [19]

Tucker et al.

[11] Patent Number: 4,974,753

[45] Date of Patent: Dec. 4, 1990

[54] LIQUID DISPENSER CONTAINER AND HOLDER SYSTEM

[75] Inventors: Council A. Tucker, Mebane, N.C.; Jimmie L. Whittington, Diamond Bar, Calif.

[73] Assignee: James River Corporation, Oakland, Calif.

[21] Appl. No.: 432,072

[22] Filed: Nov. 6, 1989

[51] Int. Cl.[5] ..... B67D 5/06

[52] U.S. Cl. ..... 222/181; 222/325; 141/363

[58] Field of Search ..... 222/181, 183, 185, 325, 222/207, 212, 214; 141/363, 365, 366, 386

[56] References Cited

U.S. PATENT DOCUMENTS 4,199,081 4/1980 Mason ..... 222/181
4,345,627 8/1982 Cassia ..... 222/325
4,429,812 2/1984 Steiner et al. ..... 222/181
4,673,109 6/1987 Cassia ..... 222/181
4,886,192 12/1989 Cassia ..... 222/181

FOREIGN PATENT DOCUMENTS 2727679 11/1978 Fed. Rep. of Germany ..... 222/181

*Primary Examiner*—Andres Kashnikow
*Assistant Examiner*—Karen B. Merritt
*Attorney, Agent, or Firm*—Thomas R. Lampe

[57] ABSTRACT

A container including neck structure with a key element thereon, dispenser means attached to the neck structure, and a holder defining a notch which will hold the container only when the container is in a predetermined orientation and the key element is positioned in the notch.

7 Claims, 3 Drawing Sheets

LIQUID DISPENSER CONTAINER AND HOLDER SYSTEM

TECHNICAL FIELD

This invention relates to a dispenser system for liquid soap and the like. More particularly, the system includes a container of a specified character, dispenser means attached to the container, and a holder including a receptacle for receiving and retaining the dispenser means external support structure. The container includes a key element and the holder defines a notch for receiving the key element.

Retention of the dispenser means external support structure by the receptacle only takes place when the container is in a predetermined orientation and the key element is received by the notch. Thus, the system provides an effective arrangement for "locking out" containers of different configuration or which incorporate key elements improperly located relative to the notch when the container is in its predetermined orientation.

BACKGROUND ART

With the present arrangement, a particular key element-notch location may be associated with a particular type of soap or other liquid in a container. For example, hospitals and other health care facilities often require that a soap have certain disinfectant characteristics. By utilizing the system of this invention, a holder incorporating a specific notch location can be installed in a health care facility and only a container containing soap with the required disinfectant characteristics can be inserted into and be retained by the holder.

DISCLOSURE OF THE INVENTION

The container of the present invention includes interconnecting walls forming an interior for accommodating a liquid, neck structure connected to the walls and defining an outlet passageway communicating with the interior, and a key element extending from the neck structure.

Dispenser means is attached to the neck structure for selectively dispensing a liquid from the container interior through the passageway. The dispenser means includes external support structure.

The third component of the system combination is a holder cooperable with the container to orient the container in a predetermined orientation relative to the holder. The holder includes a receptacle for receiving and retaining the dispenser means external support structure therein and defining a notch for receiving the key element.

The container and the holder are cooperable to permit retention of the dispenser means external support structure by the receptacle only when the container is in the predetermined orientation and the key element is received by the notch.

Other features, advantages, and objects of the present invention will become apparent with reference to the following detailed description and accompanied drawings.

BEST MODE FOR CARRYING OUT THE INVENTION

Figure 1:
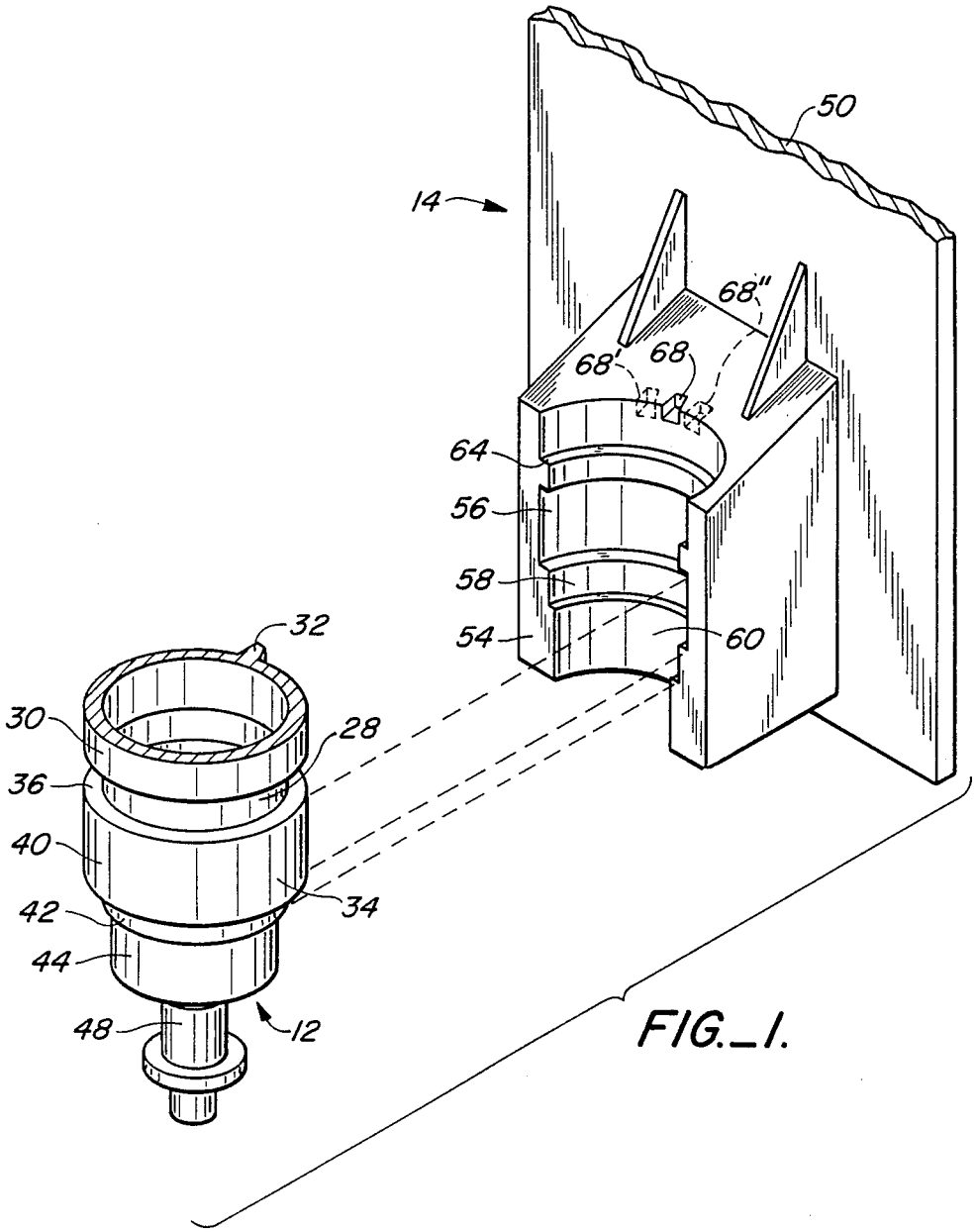
FIG. 1 is a perspective view illustrating dispenser means prior to positioning of the dispenser means into engagement with a holder receptacle constructed in accordance with the teachings of the present invention.

Referring now to the drawings, the illustrated preferred embodiment of the present invention includes a container 10, dispensing means 12, and a holder 14.

Container 10 includes interconnecting side walls 16, 18, 20, 22, top wall 24, and a bottom wall 26. The container walls form an interior for accommodating a liquid such as liquid soap (not shown).

Neck structure 28 is connected to and extends from bottom wall 26, it being understood that the neck structure, as is conventional, defines an outlet passageway communicating with the interior of the container. The container or bottle 10 is preferably constructed of plastic material which is sufficiently rigid to be self supporting but which has some degree of flexibility.

Side wall 16 has an exterior alignment surface of a predetermined configuration. In the illustrated embodiment such predetermined configuration is substantially planar.

It will be noted that neck structure 28 includes a peripherally extending rib 30 and that a key element in the form of a generally wedge-shaped projection 32 extends from the rib. The neck structure 28 is preferably integral with the remainder of the container 10 and in most instances will have a wall thickness considerably exceeding the thickness of the container walls.

Dispenser means 12 is attached to neck structure 28 by any known expedient and is for the purpose of selectively dispensing liquid from the container interior through the neck structure passageway. The precise nature of the operating mechanism incorporated in dispenser means 12 is not important insofar as the present invention is concerned. For example, the dispenser means may be in the form of a pump or just a simple valving arrangement. It will be appreciated that examples of pump and valving mechanisms utilized to dispense liquid soap and other liquid materials are well known. In the interest of simplicity, they will not be described. Co-pending U.S. application Ser. No. 07/419,334, filed Oct. 10, 1989, provides an illustration of one type of liquid dispenser pump mechanism which may be employed.

Insofar as the present invention is concerned, it is the outer configuration of the dispenser means 12 that is important. The dispenser means includes external support structure 34 which cooperates with rib 30 to define a circular groove 36. The external support structure 34 includes a plurality of spaced cylindrical surfaces 40, 42 and 44. A plunger 48 is at the bottom of the dispensing means 12 for either mechanical or hand actuation in a well-known manner to actuate the interior mechanism of the dispensing means.

Holder 14 includes a back wall 50 having a receptacle attached thereto as by being integrally formed therewith. Receptacle 54 is for the purpose of receiving and retaining the dispenser means external support structure 34. Receptacle 54 includes a plurality of generally semicircular shaped walls 56, 58 and 60 adapted to matingly engage, respectively, cylindrical surfaces 40, 42 and 44 of the dispenser means external support structure.

A projection 64 having a generally semi-circular configuration extends outwardly from receptacle wall 56. The projection 64 has a cross-sectional configuration generally corresponding to that of groove 36 and is adapted to be positioned in the groove when the dispenser means is fully seated in the receptacle to stabilize the dispenser means and prevent upward movement of the dispenser means 12 when the dispenser means is actuated.

It will be noted that a notch 68 is formed at the upper extent of receptacle 54. More specifically, the notch 68 is formed at the upper end of receptacle wall 56 and is open topped. The notch 68 corresponds generally to the shape of key element 32 projecting from rib 30 of container neck structure 28.

Figure 3:
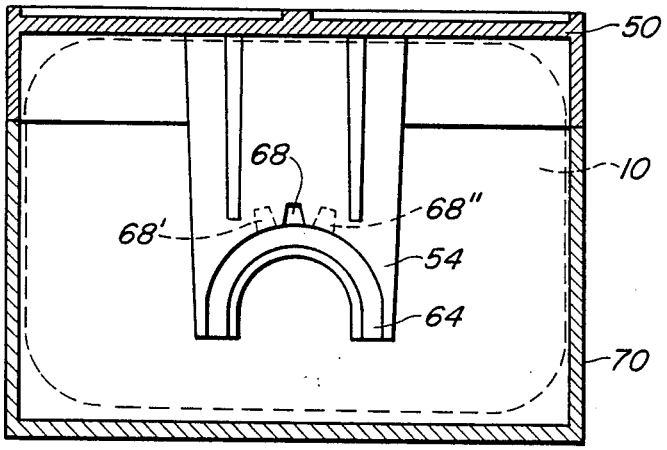
FIG. 3 is a cross sectional, diagrammatic, plan view of the holder.
Figure 4:
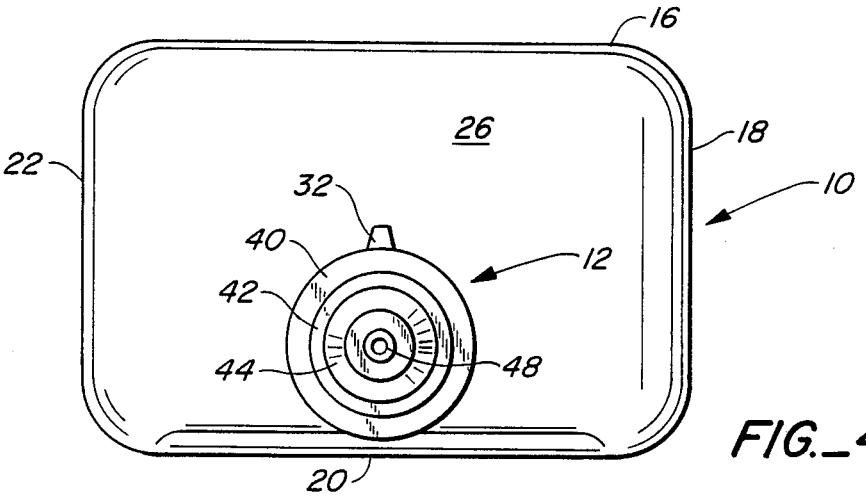
FIG. 4 is a bottom view of the container constructed in accordance with the teachings of the present invention and dispenser means attached thereto.
Figure 5:
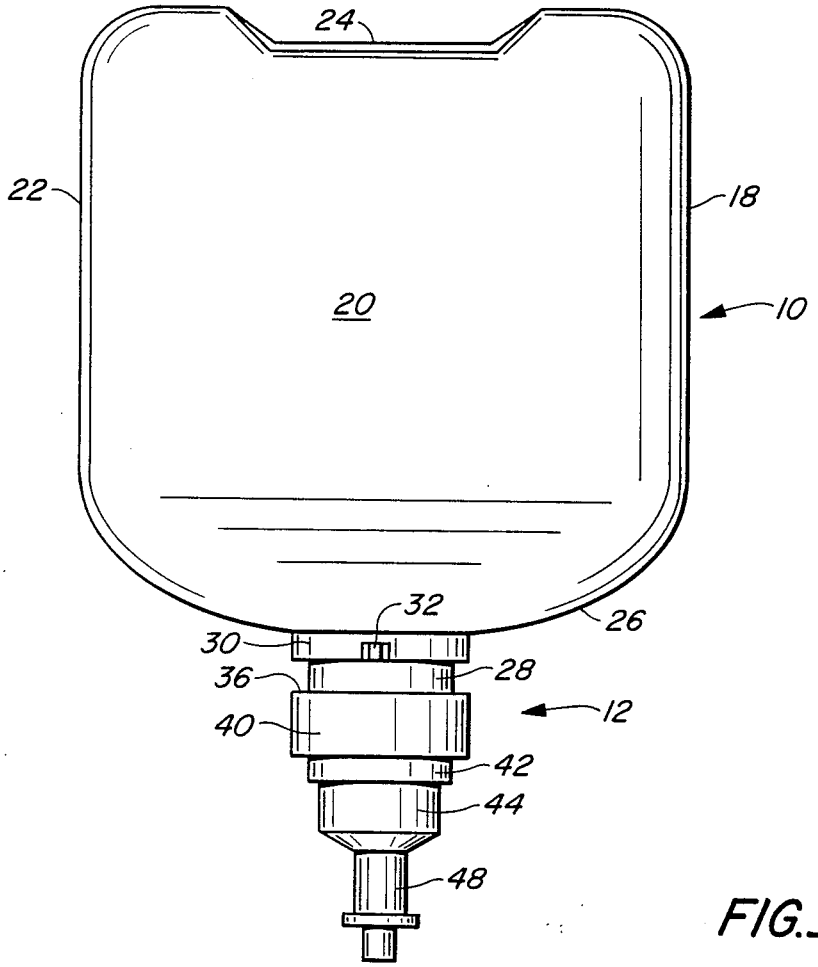
FIG. 5 is a frontal view of the container and dispenser means.

An important feature of the present invention resides in the fact that the key element extends from the container neck structure at a predetermined angle relative to the outer surface of container side wall 16. As may perhaps best be seen with reference to FIGS. 3 and 4, the outer surface of side wall 16 is of a substantially planar nature. Similarly, back wall 50 is of a substantially planar configuration. In order for the container 10 to fit in holder 14 the back wall 50 and the container side wall 16 must be in close proximity and essentially parallel to one another.

Figure 2:
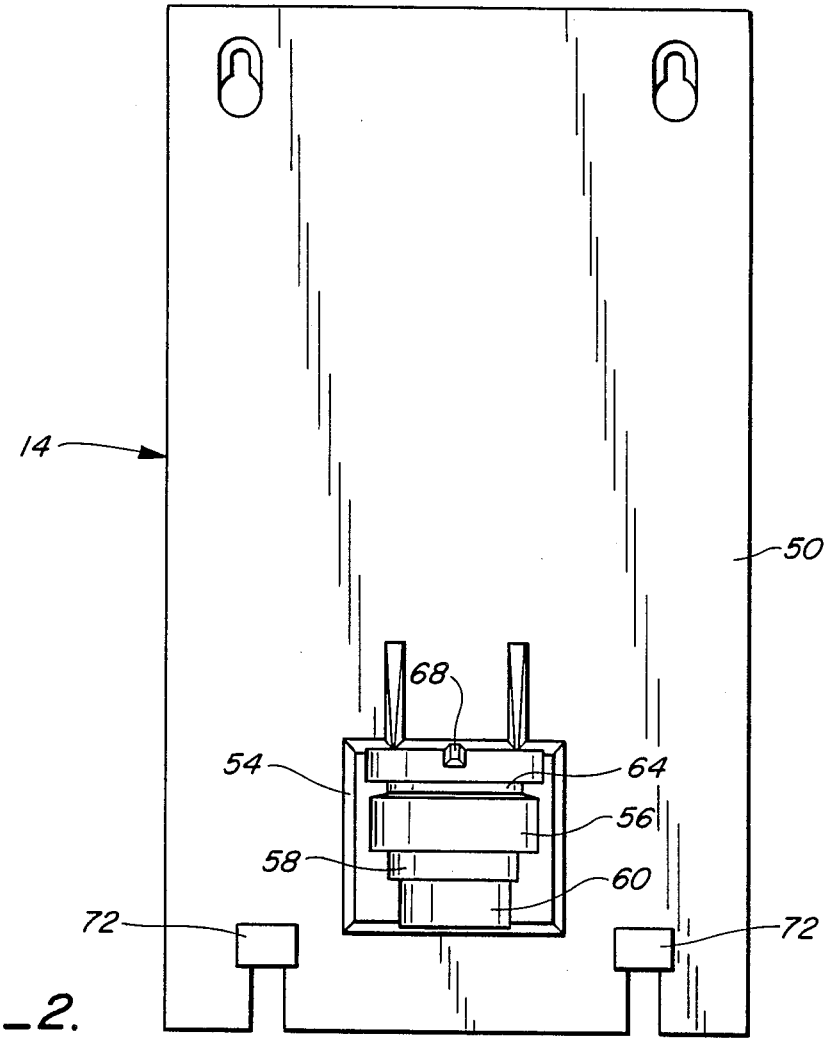
FIG. 2 is an elevation view of the holder back plate and attached receptacle.

The holder 14 includes a cover 70 attached to holder back wall 50 as by means of hinges 72 (FIG. 2). In the interest of simplicity, the cover 70 is only shown diagrammatically in FIG. 3 and when the cover 70 is closed as shown in that figure the container 10 must be in a predetermined orientation. This orientation is attained through the cooperative relationship of container side wall 16 and holder back wall 50. These walls 16, 50 must be in close proximity and in generally parallel relationship or the holder cover cannot be closed. In effect, the outer surface of side wall 16 constitutes an exterior alignment surface and the surface of holder back wall 50 facing side wall 16 constitutes a bearing surface cooperable with the alignment surface to orient the container in the predetermined orientation it must assume for the container to be properly positioned within the holder.

After the container has attained the necessary orientation, the key element 32 projecting from the container neck structure must, by necessity, be oriented in a specific manner within the holder. If the position of notch 68 does not correspond to this keY element position the key element cannot enter the notch and the receptacle 54 will not properly receive dispenser means 12.

It will be appreciated that a particular key element position may be employed with a container containing a specific type of liquid. For example, a key element projecting perpendicularly relative to the container side wall 16 outer surface could be used to package a particular liquid soap of predetermined character, such as a soap incorporating a disinfectant specified by a hospital. If the hospital only employs holders featuring a notch centrally disposed relative to receptacle wall 56 (such as notch 68) there is assurance that the correct liquid soap is being employed at all times.

Other types of liquid soap could be used in conjunction with other key element orientations and employed with holders incorporating notches at corresponding locations. By way of illustration, FIG. 1 illustrates central notch 68 in solid line. Alternative notch locations on either side thereof are illustrated by dash line and identified by reference numerals 68', 68''. In the interest of simplicity and to better show the relationship between dispenser means 12 and holder 14, only a portion of container 10, i.e. the neck structure 28, is shown in FIG. 1; however, it is to be understood that the container is an important element of the present invention and will in all cases be attached to the dispenser means 12 as previously described when the dispenser means 12 is placed in operative engagement with the holder.

What is claimed is:

1. In combination:

a container including interconnecting walls forming an interior or accommodating a liquid, neck structure connected to a wall and defining an outlet passageway communicating with said interior, and a key element extending from said neck structure;

dispenser means attached to said neck structure for selectively dispensing liquid from said container interior through said passageway, said dispenser means including external support structure; and a holder cooperable with said container to orient said container in a predetermined orientation relative to said holder, said holder including a receptacle for receiving said dispenser means external support structure therein to support said container and defining a notch for receiving said key element, said receptacle adapted to receive said dispenser means external support structure to support said container only when said container is in said predetermined orientation and said key element is received by said notch, said container neck structure including a peripherally extending rib and said rib and said dispenser means defining a groove, said receptacle including a projection selectively positionable in said groove to stabilize said container and dispenser means when said dispenser means external support structure is received by said receptacle.

2. The combination according to claim 1 wherein said key element extends from said peripherally extending rib.

3. The combination according to claim 1 wherein said groove is circular and said projection has a generally semicircular configuration and is adapted to seat in said groove.

4. In combination:

a container including interconnecting walls forming an interior for accommodating a liquid, neck structure connected to a wall and defining an outlet passageway communicating with said interior, and a key element extending from said neck structure;

dispenser means attached to said neck structure for selectively dispensing liquid from said container interior through said passageway, said dispenser means including external support structure having an outer periphery defined by a plurality of spaced cylindrical surfaces of differing diameters; and a holder cooperable with said container to orient said container in a predetermined orientation relative to said holder, said holder including a receptacle for receiving said dispenser means external support structure therein to support said container and defining a notch for receiving said key element, said receptacle adapted to receive said dispenser means external support structure to support said container only when said container is in said predetermined orientation and said key element is received by said notch.

5. The combination according to claim 4 wherein said receptacle includes a plurality of generally semi-circular shaped walls adapted to matingly engage said plurality of spaced cylindrical surfaces when said container is in said predetermined orientation and said key element is received by said notch.

6. In combination:

a container including interconnecting walls forming an interior for accommodating a liquid, at least one of said walls having an exterior alignment surface of a substantially planar configuration, neck structure including a peripherally extending rib, said neck structure connected to a wall and defining an outlet passageway communicating with said interior, and a key element extending from said rib at a predetermined angle relative to said substantially planar alignment surface; and dispenser means attached to said container neck structure for selectively dispensing liquid from said container interior through said passageway, said dispenser means having an outer periphery defined by a plurality of spaced cylindrical surfaces of differing diameters, said dispenser means and said container rib being spaced from one another and defining a circular groove.

7. A holder for use in connection with a container including interconnecting walls forming an interior for accommodating a liquid, at least one of said walls having an exterior alignment surface of a predetermined configuration, said container additionally including neck structure defining an outlet passageway communicating with said interior and a key element extending from said neck structure, and dispenser means attached to said neck structure for selectively dispensing liquid from said container interior through said passageway, said dispenser means including external support structure, said holder comprising means having a bearing surface and including a receptacle adapted to receive and retain said dispenser means external support structure therein and defining a notch for receiving said key element, said holder cooperable with said container to permit retention of said dispenser means external support structure by said receptacle only when said key element is received by said notch and said alignment surface and said bearing surface are in generally parallel relationship.

* * * * *